United States Patent [19]

Besnyo et al.

[11] 3,975,883

[45] Aug. 24, 1976

[54] COILING AND BINDING STRAND MATERIAL

[75] Inventors: George Frank Besnyo, Towson; Byron Lee Small, Parkville, both of Md.

[73] Assignee: Western Electric Company, Inc., New York, N.Y.

[22] Filed: Apr. 30, 1975

[21] Appl. No.: 573,272

[52] U.S. Cl. ..... 53/3; 53/118; 53/198 R

[51] Int. Cl.[2] ..... B65B 63/04

[58] Field of Search ..... 53/3, 198 R, 118; 242/53; 28/21

[56] References Cited

UNITED STATES PATENTS

| | | | |
|---|---|---|---|
| 1,958,068 | 5/1934 | Raiche | 53/118 X |
| 2,008,477 | 7/1935 | Twaddle | 242/53 |
| 2,204,869 | 6/1940 | Schenck, Jr. | 242/53 |
| 2,331,004 | 10/1943 | Standish | 242/53 X |
| 2,654,980 | 10/1953 | Dexter | 53/198 R X |
| 2,712,836 | 7/1955 | Marzolf | 242/53 X |
| 3,416,287 | 12/1968 | Hawkins et al. | 53/198 R X |
| 3,832,829 | 9/1974 | Stout | 53/198 R |

*Primary Examiner*—Travis S. McGehee
*Assistant Examiner*—John Sipos
*Attorney, Agent, or Firm*—E. W. Somers

[57] ABSTRACT

Coiling and binding of strand material such as telephone cordage is accomplished by revolving cyclically spaced coiling heads mounted rotatably on a rotatably mounted turret between one position where a length of deformable tie material is preloaded on the coiling head and another position whereat a predetermined number of convolutions of cordage are wound on the coiling head such that the tie spans diametrically of and extends beyond the convolutions. The winding in the other position occurs while the tie of the previously wound cordage now in the one position is formed about the cordage such that each end portion of the tie encloses and binds together an adjacent plurality of corresponding portions of the convolutions whereafter the coiled, bound cordage is ejected from the head in the one position. The hed in the one position is loaded with another tie while the coiled cordage on the head in the other position is severed from a supply preparatory to the revolving of the heads to interchange the positions thereof to facilitate another cycle of operation in which the coiled cordage moved into the one position is bound and the head preloaded with a tie has convolutions wound thereon in the other position.

16 Claims, 23 Drawing Figures

COILING AND BINDING STRAND MATERIAL

BACKGROUND OF THE INVENTION

1. Field of the Invention

This invention relates to coiling and binding strand material and, more particularly, to methods of and apparatus for providing a hank or length of coiled cordage having a plurality of convolutions with end portions of the cordage extending therefrom and with adjacent corresponding portions of the convolutions being bound together at substantially opposed points of the coiled cordage.

2. Prior Art

The communications industry requires the provision of telephone line cords which connect telephone handsets to a wall terminal. These are provided to an installer in the form of a length of cordage such as for example that described in U.S. Pat. No. 3,868,341 coiled in a predetermined number of convolutions with the ends thereof subsequently finished. The finishing includes, for example, the assembly of modular plugs, such as for example those illustrated in U.S. Pat. Nos. 3,699,498 and 3,761,869 to the ends of the cordage. Prior art coil or hank winding is known. For example, see U.S. Pat. No. 2,654,980.

Desirably, the cordage is coiled prior to end finishing. It is therefore important that the coil be maintained intact during the end finishing operation. Many prior art techniques resort to the application of a tie, e.g., a thermoplastic band, about the entire coil after the convolutions thereof have been elongated so that opposite portions of the convolutions are adjacent each other. See, for example, U.S. Pat. No. 3,024,580. Pull-out of ones of convolutions coiled and secured in this manner could occur.

The prior art, for example, U.S. Pat. No. 2,349,750, shows the bending of upper extremeties of a U-shaped clip to become curled over adjacent convolutions of a wire entanglement used in warfare.

Coiling cordage and then moving the coil to a station where a tie is introduced centrally of the coil and then tied about one section of the coil is shown on page 19 of Western Electric Technical Digest No. 34, April, 1974 issue. Moving the unbound coil tends to distort the configuration thereof and causes problems when attempting to introduce the tie.

SUMMARY OF THE INVENTION

A method of forming bound hanks of cordage in accordance with the principles of this invention includes the steps of supporting a tie in a work position, winding a plurality of convolutions of cordage in a coil in the work position to form a hank such that the tie spans generally diametrically the convolutions with end portions of the tie extending beyond the convolutions, reforming the tie to move each end portion of the tie into enclosing securing relationship with adjacent associated corresponding portions of the plurality of convolutions to bind together the corresponding portions, removing the bound hank of cordage from the work position, and positioning another tie in preparation for another cycle of winding and binding cordage to form a bound hank of cordage.

An apparatus for producing bound hanks of cordage in accordance with the principles of this invention includes facilities for supporting a tie in a work position, facilities for winding a plurality of convolutions of cordage to form a hank in the work position such that the tie spans generally diametrically the convolutions with end portions of the tie extending beyond the convolutions, facilities for reforming the tie to move each end portion of the tie into enclosing circumferential relationship with associated corresponding portions of the plurality of convolutions to bind together each plurality of corresponding portions, facilities for removing the bound hank of cordage, and facilitates for positioning another tie in preparation for the next successive cycle of operation of winding and binding cordage to form a bound hank of cordage.

BRIEF DESCRIPTION OF THE DRAWINGS

Other objects and advantages of the invention will appear from the following detailed description of a specific embodiment thereof when read in conjunction with the accompanying drawings in which.

DETAILED DESCRIPTION

Product Description

Figure 1:
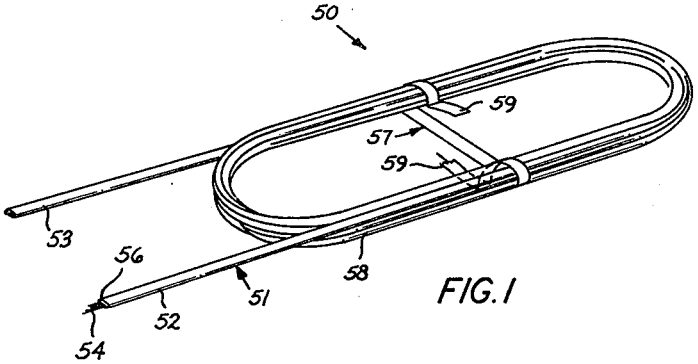
FIG. 1 is a perspective view of a bound hank of cordage wound and tied in accordance with the principles of this invention.

Referring now to FIG. 1, there is shown a bound, coiled length of telephone cordage, designated generally by the numeral 50, which includes coiled cordage 51, referred to in coil winding as a hand, having unfinished free ends 52 and 53 to which are assembled plugs such, as for example, those disclosed and claimed in U.S. Pat. Nos. 3,699,498 and 3,761,869. The coiled cordage 51 includes a plurality of individually insulated conductors 54—54 enclosed by a jacket 56.

Figure 2A:
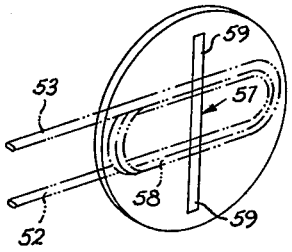
FIGS. 2A–2C are a sequence of views showing the steps in coiling and binding the coiled cordage of FIG. 1.

The methods and apparatus which embody the principles of this invention are used to produce the coiled cordage 50, shown in FIG. 1, having the coils thereof secured against pull-out. The securing is accomplished by spanning a deformable tie 57, e.g., a paper or plastic laminated wire twist-tie across the cordage wound in a coil or hank 58 such that end portions 59—59 of the tie extend beyond the coil (see FIG. 2A). One such twist-tie is a HANSCOM-TIE available commercially from H. T. Hanscom and Company, Inc. of Providence. R. I. and includes a ¼ inch wide plastic laminated 21 gauge soft carbon steel wire.

Figure 2B:
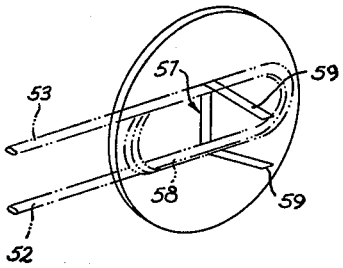
Figure 2C:
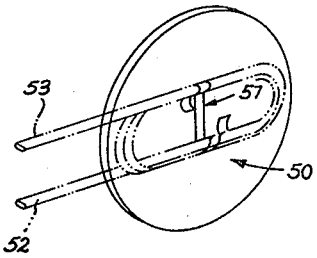

Then each of the end portions 59—59 are deformed such as to enclose an adjacent plurality of corresponding portions of the convolutions of the coil 58. This accomplished in two steps as is shown in FIGS. 2B and 2C. First, the end portions 59—59 of the tie 57 are deflected to form the tie into a generally U-shaped configuration. Then the end portions 59—59 are formed about the portions of the convolutions to secure the convolutions against inadvertent pull-out.

Overall Apparatus

Figure 3:
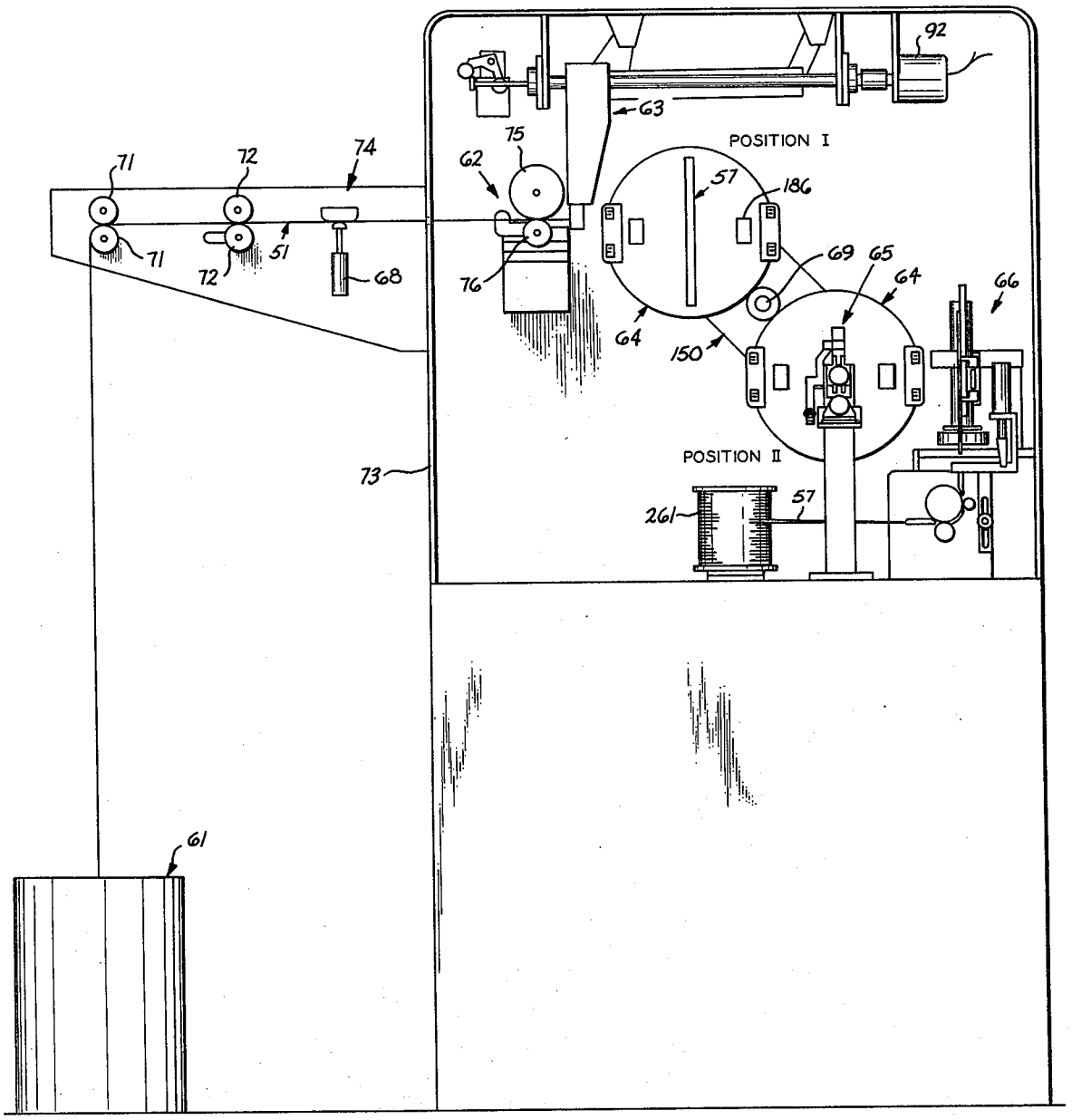
FIG. 3 is a front elevational view of an apparatus for coiling and binding cordage in accordance with the principles of this invention.
Figure 18:
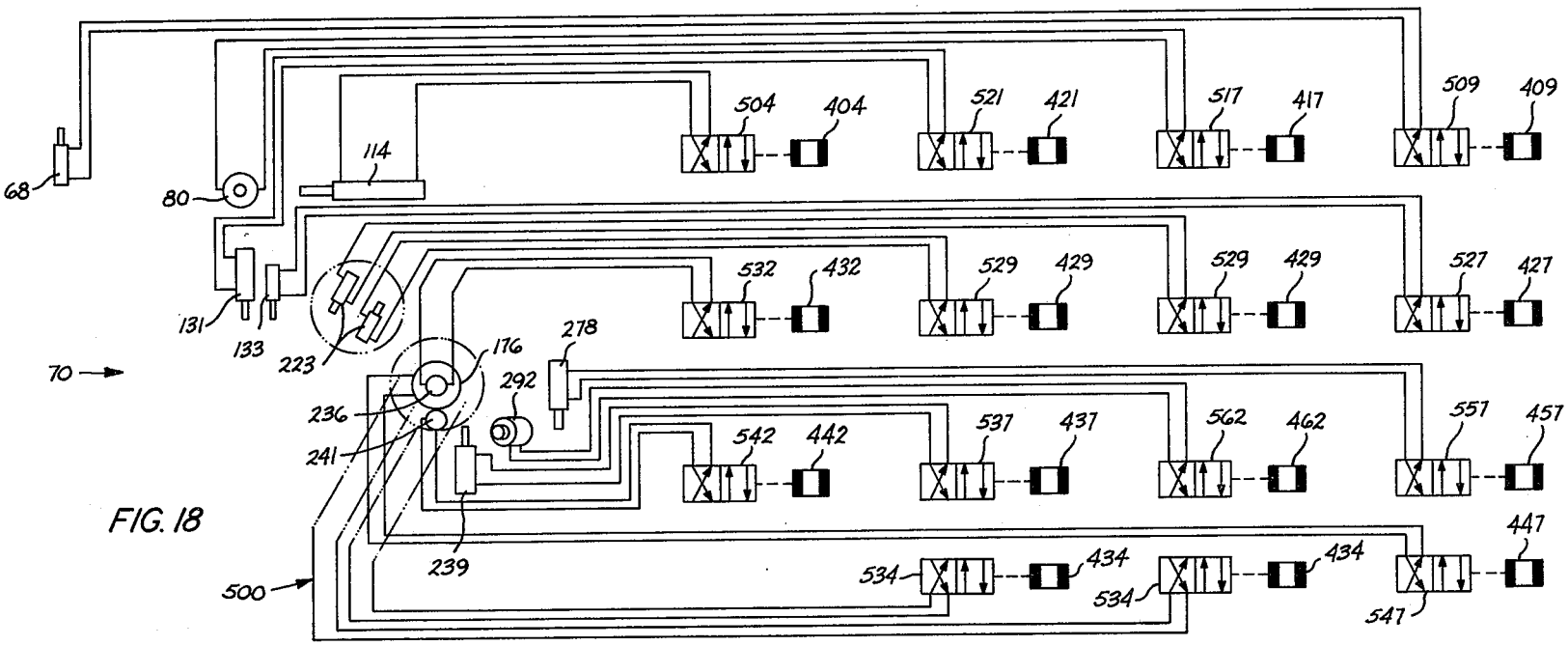
FIG. 18 is a schematic view showing a pneumatic control system for the apparatus of FIG. 3.
Figure 17:
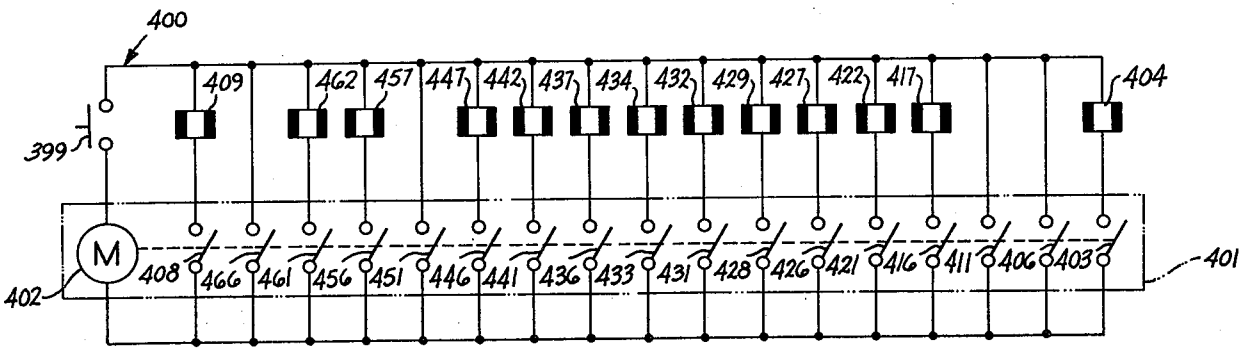
FIG. 17 is an electrical control circuit for the apparatus.

An apparatus which embodies the principles of this invention for producing bound hanks of cordage is shown in FIGS. 3, 17 and 18, and is designated generally by the numeral 60. The apparatus 60 includes a supply, designated generally by the numeral 61, of cordage, a distributor, designated generally by the numeral 62, a cordage positioner, designated generally by the numeral 63, for positioning, for example, a leading end of the cordage 51 in one of a pair of individually rotatable workholders or coiling heads, each designated generally by the numeral 64, a cordage binding device, designated generally by the numeral 65, a deformable tie loading device, designated generally by the numeral 66, for loading a section of deformable tie in the other one of the heads 64—64, and a control circuit designated generally by the numeral 70 which is typical of that which may be used to control the operation of the apparatus 60.

Figure 4A:
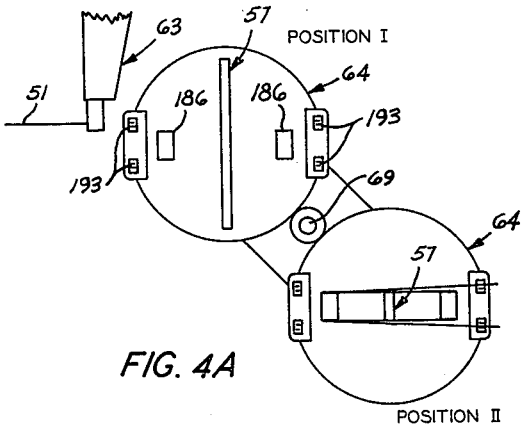
FIGS. 4A–4C are a sequence of views showing the steps in the operation of the apparatus of FIG. 3.
Figure 4B:
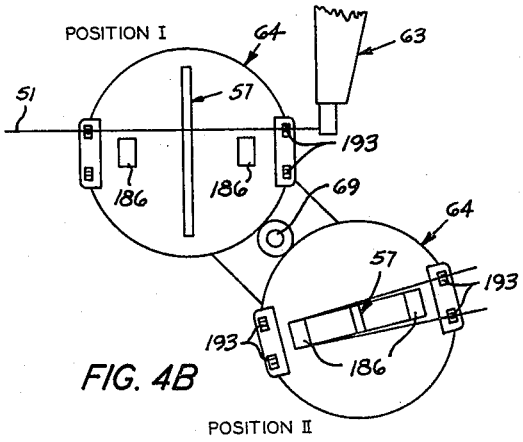
Figure 4C:
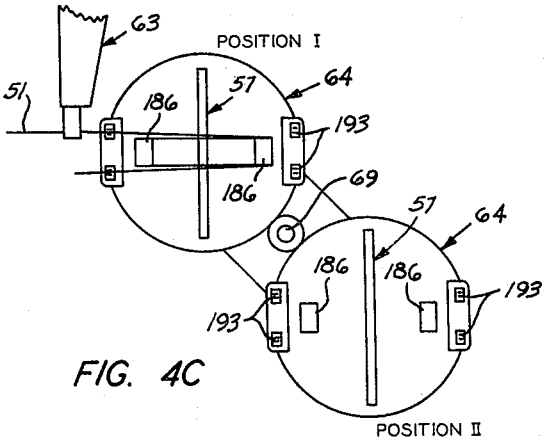

The apparatus 60 is used to carry out the principles of the method of this invention which are shown in the sequence of views identified as FIGS. 4A–4C. Initially, the cordage positioner 63 is moved horizontally from a position shown in FIG. 4A to a position shown in FIG. 4B and then inwardly to insert a leading end of the cordage 51 into securing engagement with the one of the heads 64—64 which is in a coil-winding position designated position I. The cordage positioner 63 is then returned to its initial position and the head 64 in the position I turned rotatably to wind a hank having a predetermined number of convolutions as the cordage is withdrawn from the supply 61 and distributed on the workholder by the distributor 62.

Subsequent to the coil winding on the head 64 in position I, the tie loading device 66 (see FIG. 3) is caused to move a length 57 of a deformable tie material, such as the familiar plastic or paper laminated wire twist-tie used to secure the open ends of commercially available packages, into engagement with the head 64 in a binding position, designated position II. It should be noted that prior to the coiling of the cordage 51 on the head 64 in position I, the head had been preloaded in a similar fashion with a length of the deformable tie material.

The coiling is discontinued such that the free end of the cordage 51 is oriented as shown in FIG. 4C whereafter the cordage positioner 63 severs the cordage from the supply 61 and attaches the newly formed trailing end to the head 64. Portions of the head 64 are operated to deform the ends of the tie into an upstanding position (see FIG. 2B). The heads 64—64 are revolved about an axis 69 to move that head having the length of deformable tie 57 into position I and the coiled cordage 51 underlain by a similar length of deformable tie into position II.

As the coiling proceeds on the head 64 now in position I, the apparatus 60 is operated to further deform the tie 57 on the head in position II to secure adjacent corresponding portions of the convolutions at generally opposed points of the hank. The free upstanding end portions 59—59 of the tie 57 are moved toward each other and then inwardly toward the associated adjacent portions of the plurality of convolutions. Then the free end portions 59—59 of the tie 57 are tucked under the associated portions of the convolutions to form the bound hank 50 shown in FIG. 1. The bound hank 50 is ejected from the apparatus 60 and directed into one of two bins (not shown) in accordance with electrical tests conducted priorly.

The apparatus 60 is operated to load another length 57 of the deformable tie material onto the head 64 in position II while the cordage positioner 63 is severing the coiled cordage 51 from the supply 61 and attaching the newly formed trailing end to the head in position I. The heads 64—64 are revolved about the axia 69 to interchange the positions thereof and to begin another cycle of operation.

These techniques and apparatus advantageously are capable of producing on a volume basis coiled cordage having the convolutions bound in such a way as to prevent pull-out of the convolutions. The arrangement in which coiling is performed on one workholder while already coiled cordage is bound on a second workholder interchangeable in position with the first workholder followed by the ejection of the bound coiled cordage and the preloading of the second workholder provides desirably for an extremely efficient operation.

Initial String-Up

An operator threads a leading end of the cordage 51 from the supply 61 between opposed sheaves 71—71 (see FIG. 3) and then between opposed sheaves 72—72 supported from a framework 73. The leading end of the cordage 51 is then strung up through a tensioning clamp 74 operated by an air cylinder 68 and then to the distributor 62.

Figure 5:
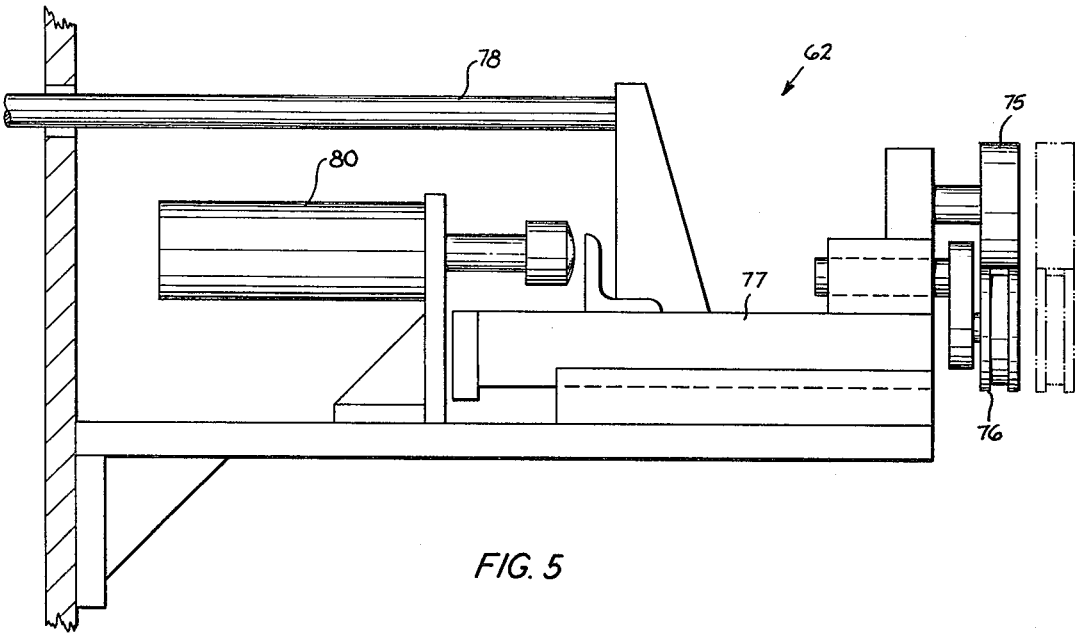
FIG. 5 is an elevational view of a portion of a device for distributing the cordage.

The distributor 62 (see FIG. 5) may be any of many strand-distributive devices which are well known in the art. For example, the distributor 62 may include opposed coacting smooth and grooved rollers 75 and 76, respectively, for receiving the cordage 51 therebetween. The rollers 75 and 76 are mounted in a slidably mounted support 77 which is moved reciprocally cyclically into and the plane of the drawing to cause a distribution of the cordage 51 on the head 64 in position I. The cyclical reciprocal motion of the support 77 may be, for example, by way of a cam-actuated push-rod 78 which is caused to be moved by the operation of an air cylinder 79.

The distribution of cordage 51 occurs only over a short span, typically less than one inch and becomes important especially for the longer lengths of cordage 51 which are coiled.

The distributor 62 includes a second air cylinder 80 (see FIG. 5) which is connected to the slidably mounted support 77. The air cylinder 80 is effective in assisting the cordage positioner 63 in the attaching of the cordage 51 to the head 64 in position I at the conclusion of each cycle of coiling of the cordage. The operation of the air cylinder 80 moves the cordage 51 outwardly to the phantom position shown in FIG. 5 as the cordage positioner 63 is being moved inwardly to positively seat the cordage within the positioner.

Cordage Positioner

Figure 6:
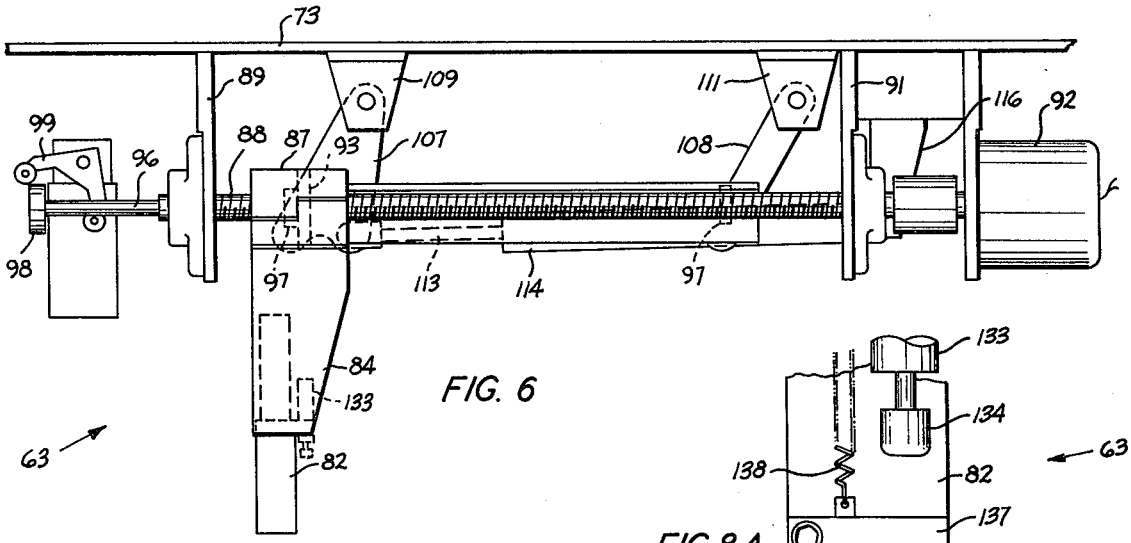
FIG. 6 is an elevational view of a portion of the apparatus at FIG. 3 and showing a cord-positioning device.
Figure 8A:
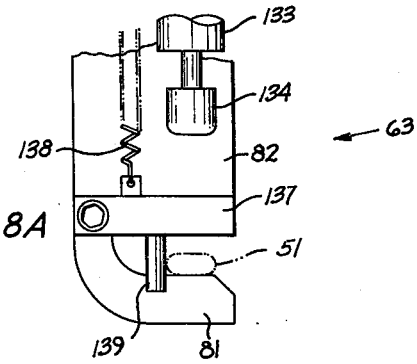
FIG. 8A is a view taken along lines 8A—8A in FIG. 8 showing a cordage clamp.
Figure 7:
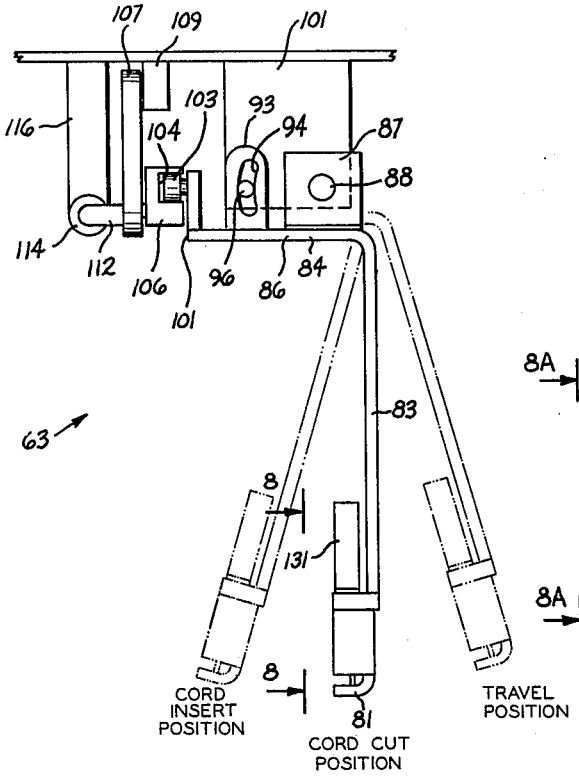
FIG. 7 is a side elevational view of a portion of the cord-positioning device.
Figure 8:
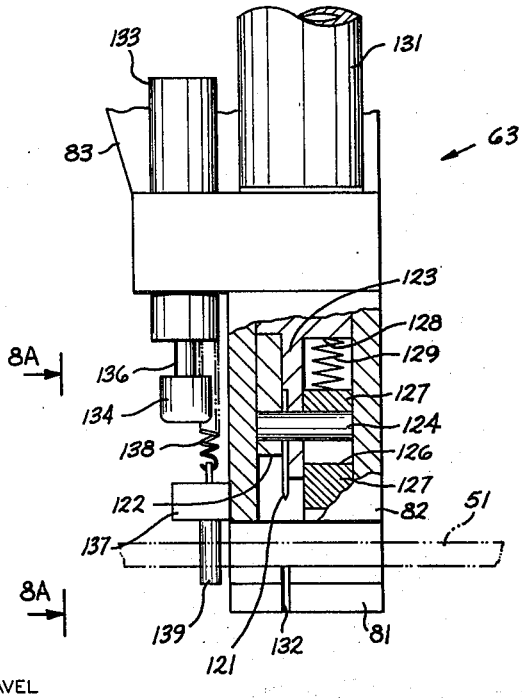
FIG. 8 is a view taken along lines 8—8 in FIG. 7 and showing cordage severing and clamping facilities.

Referring now to FIGS. 6 and 7 and 8, there is shown the cordage positioner 63 into which a leading end of the cordage 51 is held to begin a cycle of operation. The cordage positioner 63 includes generally a cord-engaging portion 81 connected to a housing 82. The housing 82 is attached to a depending leg 83 of an angular bracket 84. The bracket 84 has a leg 86 extending laterally of the portion 84 and connected to a bearing block 87 which is supported on and is moveable along a shaft 88.

The shaft 88 is supported between two bearing plates 89 and 91 (see FIG. 6) with one end connected to a stepper motor 92 such as a SLO-SYN, available commercially as a tradename article from Superior Electric Co.

The bracket 84 also has a plate 93 upstanding therefrom and having a slot 94 cut arcuately therein. The slot 94 is designed to have a rod 96 extending slideably therethrough. The rod 96 has collars 97—97 attached at intermediate locations therealong and a stop 98 attached to the end thereof (see FIG. 6).

The stop 98 is designed to engage a limit switch 99 which controls the operation of the stepper motor 92. Assuming that the stop 98 is in engagement with the limit switch 99, the stepper motor 92 moves the cordage positioner 63 to the right as viewed in FIG. 6 until the cordage positioner reaches approximately the position shown in FIG. 4C. The plate 93 engages one of the collars 97 and carries that collar and rod 96 to the right a distance of about one inch. This disengages the stop 98 from the limit switch 99 which causes the control circuit 70 to discontinue the operation of the stepper motor 92 to permit the cordage positioner 63 time sufficient to attach a leading end of the cordage 51 to the head 64 in position I (see FIG. 4B).

After a preset delay, the disengagement of the stop 98 with the limit switch 99 causes the stepper motor 92 to be operated to move the cordage positioner 63 to the left as viewed in FIG. 6 and causes the plate 93 to engage the other collar 97. The collar 97 and the rod 96 are carried with the cordage positioner 63 a slight distance, e.g., on the order of one inch, to the left until the stop 98 engages and operates the limit switch 99. This causes the control circuit 70 to discontinue the operation of the motor 92 sufficiently long enough for the cordage positioner 63 to be moved clockwise as viewed in FIG. 7 to sever the cordage 51 and attach the trailing end to the head 64 in position I.

A free end 101 of the leg 86 of the bracket 84 has a post 102 upstanding therefrom and from which extends a cam follower 103 that rides along a cam slot 104 in a C-shaped guide bar 106. The guide bar 106 is attached to hangars 107 and 108 supported pivotally from brackets 109 and 111, respectively.

Further, the hangar 107 has a stud 112 projecting therefrom and connected to a piston rod 113 extendable from a three position air cylinder 114. The other end of the air cylinder 114 is pin connected to a hangar 116 (see FIG. 6) which is attached to the framework 73.

It should be observed that the mounting of the air cylinder 114 permits advantageously the entire cordage positioner 63 to be swung in a slight arc clockwise or counterclockwise of the solid line position shown in FIG. 7. This adds desirably to the motion capability of the cordage positioner 63 in that it may be moved generally in each of two coordinate directions to enable it to positively position the cordage 51 in, for example, clamping facilities of the apparatus 60 to be described hereinafter.

As is shown in FIG. 7 the cordage positioner 63 is moveable arcuately of the plane of the coiling heads 64—64 into any one of three positions. The position shown in solid lines in FIG. 7 is that position assumed to effect a severing of the cordage 51 from the supply 61. The axis shown slightly counterclockwise of the solid line position is the position assumed by the cordage positioner in its travel longitudinally along the shaft 88. Finally, the axis shown in FIG. 7 just slightly clockwise of the solid line position is that assumed by the cordage positioner 63 in attaching a leading or trailing end of the cordage 51 to the coiling head 64 in position I.

The operation of the air cylinder 114 to extend the piston rod 113 causes the pivotally mounted hangar plate 107 to move to the left as viewed in FIG. 6. The rigid connection of the stud 102 to the end 101 of the bracket 84 causes the bracket 84 to pivot slightly clockwise about the shaft 88 as viewed in FIG. 7. Retraction of the piston rod 113 causes the bracket 84 to be repivoted counterclockwise as viewed in FIG. 7 to the position thereshown and beyond if the cordage positioner is to be moved along the shaft 88.

The cordage positioner 63 also has facilities for positively clamping the cordage 51 and for severing cordage from the supply 61 thereof. As can be seen in FIG. 8, the cordage positioner 63 includes a blade 121 mounted within the housing 82 between plates 122 and 123. A pin 124 extends through the blade 121 and through close-fit openings in the plates 122 and 123 and also through an enlarged opening 126 in a slide plate 127. The slide plate 127 is biased from a ledge 128 of the plate 123 by a pair of springs 129—129.

The plate 123 is moveable slidably by an air cylinder 131. As the assembly is moved downwardly from a rest position shown in FIG. 8, the springs 129—129 move the plate 127 downwardly. This movement of the plate 127 causes a portion of the cordage 51 to be moved against the portion 81 of the housing and exerts clamping forces against the cordage 51. Further movement of the plate 127 moves the lower portion of the blade 121 first through the cordage 51 to sever the cordage and then into a slot 132 in the lower portion 81 of the cordage positioner 63.

The housing 82 also supports a second air operated cylinder 133 (see FIG. 8) which has an enlargement 134 attached to a rod 136 extendable from the air cylinder. The operation of the air cylinder 133 moves the enlargement into engagement with a pivotally mounted clamp 137 (see FIG. 8A) to clamp the cordage 51 against the portion 81. The clamp 137 has a stop 139 attached thereto. When the air cylinder 133 is returned to an unoperated condition, a spring 138 disengages the clamp 137 from the portion 81.

Coiling Heads

The coiling of the cordage is accomplished cyclically on each one of the pair of identical heads 64—64. The heads 64—64 are mounted individually rotatably on a turret designated generally by the numeral 150 and which includes spaced plates 151 and 152 (see FIG. 10). The plates 151 and 152 are mounted rotatably on the framework 73 such that the turret 150 is rotatable about the axis 69 (see FIG. 3) with the individual heads 64—64 cyclically moveable between the coiling position I and the cordage-binding position II. The plates 151 and 152 are spaced apart by standoffs 156—156 (see FIG. 10).

Figure 10:
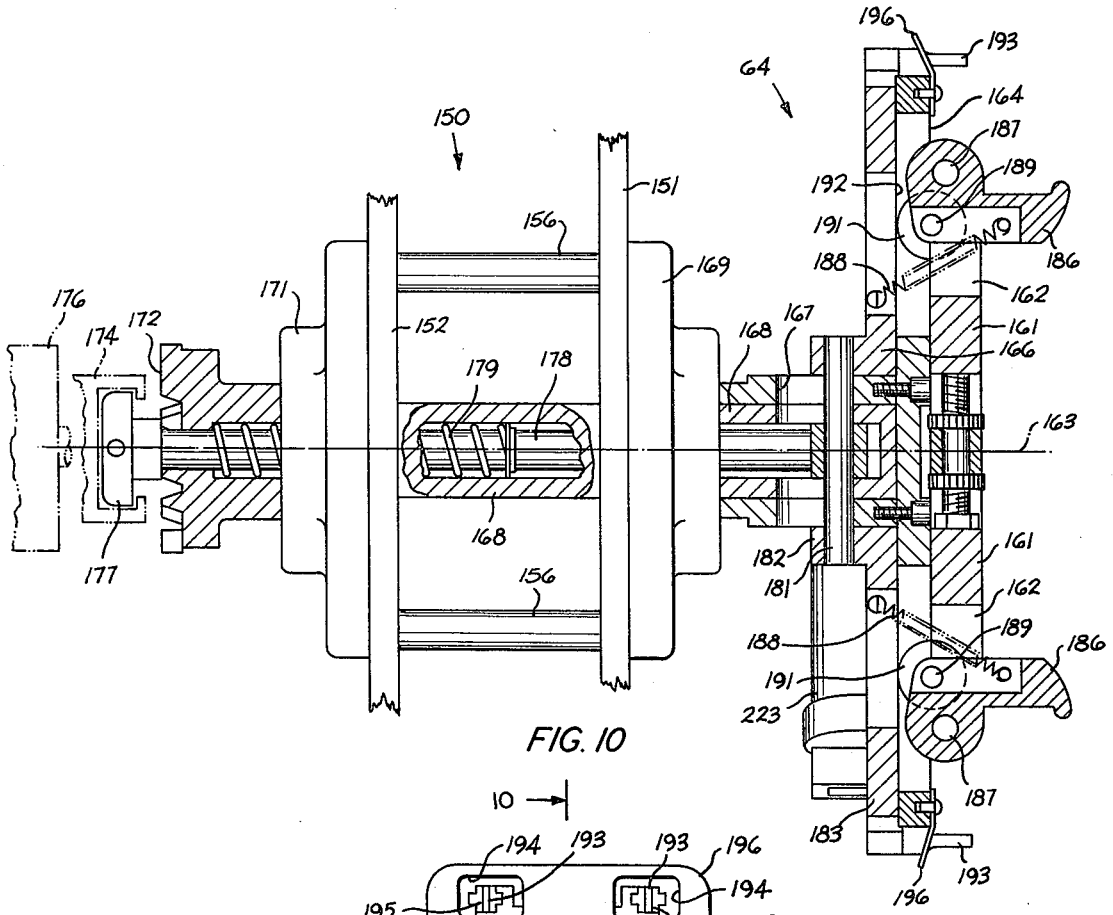
FIG. 10 is a side view partially in section taken along lines 10—10 in FIG. 9.

As can be seen from FIG. 10, each of the coiling heads 64—64 includes a plate 161 having diametrically opposed openings 162—162 formed therein and spaced equidistantly from an axis 163 to the center of the plate. The coiling heads 64—64 also includes a plate 164 contiguous to the plate 161. The plates 161 and 164 are connected to a hub 166 having openings 167—167 formed therein and connected to a hollow shaft 168 mounted in bearings 169 and 171 which are mounted on the plates 151 and 152, respectively, of the turret 150. In this way the plates 161 and 164 remain in the same planes throughout the operation of the apparatus 60.

Each of the coiling heads 64—64 also includes a clutch 172. The clutch 172 is adapted to be engaged by a drive member (not shown) which is associated with the coiling position I to turn rotatably the head 64 in that position to coil the cordage 51. (See FIG. 10)

Each of the heads 64—64 also includes facilities for holding the cordage 51 during winding and for releasing the coiled cordage. The apparatus 60 includes a claw-like member 174 (see FIG. 10) connected to an air cylinder 176. The member 174 is adapted to engage a headed end 177 of a rod 178 which extends through the clutch 172 and through the hollow shaft 168. The rod 178 has a spring 179 disposed concentrically thereabout. The rod extends through the hub 166 and is connected by a pin 181 to a bushing 182 having arms 183—183 extending therefrom and aligned with the openings 162—162 in the plate 161. Further, it should be observed from FIG. 10 that the pin 181 extends through the openings 167—167 in the hub 166. In this way, the retraction of the rod 178 to the left as viewed in FIG. 10 urges the pin 181 and hence the attached arms 183—183 to the left to space apart the arms from the plate 164.

In order to coil the cordage 51 on the head 64, a pair of winding posts 186—186 (see FIGS. 9 and 10) are mounted pivotally on the pins 187—187 attached to the plate 161. Moreover, the posts 186—186 are designed so as to be movable pivotally inwardly of the openings 162—162 formed in the plate 161. Each of the winding posts 186—186 is spring-biased by a tension spring 188 connected to the associated one of the arms 183—183. Further, each of the winding posts 186—186 has a pin 189 extending therefrom for supporting rotatably a camming member 191.

When the arms 183—183 are moved to the left as viewed in FIG. 10, the springs 188—188 cause the winding posts 186—186 to be moved clockwise and counterclockwise inwardly through the openings 162—162 in the plate 161 and to be withdrawn out of the plane of the face of the plate 161. This movement of the arms 183—183 is caused to occur when it is desired to permit ejection of the wound, secured cordage from the coiling head 64 in the position II.

Further, viewing FIG. 10, it can be seen that when the rod 178 is moved to the right by the air cylinder 176, the arms 183—183 are moved toward plate 164. Camming members 191—191 are engaged by surfaces 192—192 of the arms 183—183 to overcome the action of the springs 188—188 and cause the winding posts 186—186 to extend upward through the openings 162—162 normally of the plate 161 to facilitate another cycle of winding of the cordage 51.

Moreover, each of the arms 183—183 has two clamps 193—193 attached thereto and which are best seen in FIG. 10. Each of the clamps 193—193 comprises resilient fingers 195—195, e.g., leaf springs, which extend through an opening 194 in a stripping member 196. The resilient fingers 195—195 are spaced apart slightly less than the smallest outer dimension of the cordage 51 which is to be grasped therebetween. The clamps 193—193 are connected to the arms 183—183 so that when the arms 183—183 are moveable reciprocally to the left, for example, as shown in FIG. 10, the clamps are withdrawn through the openings 194—194 in the stripping members 196—196.

Figure 9:
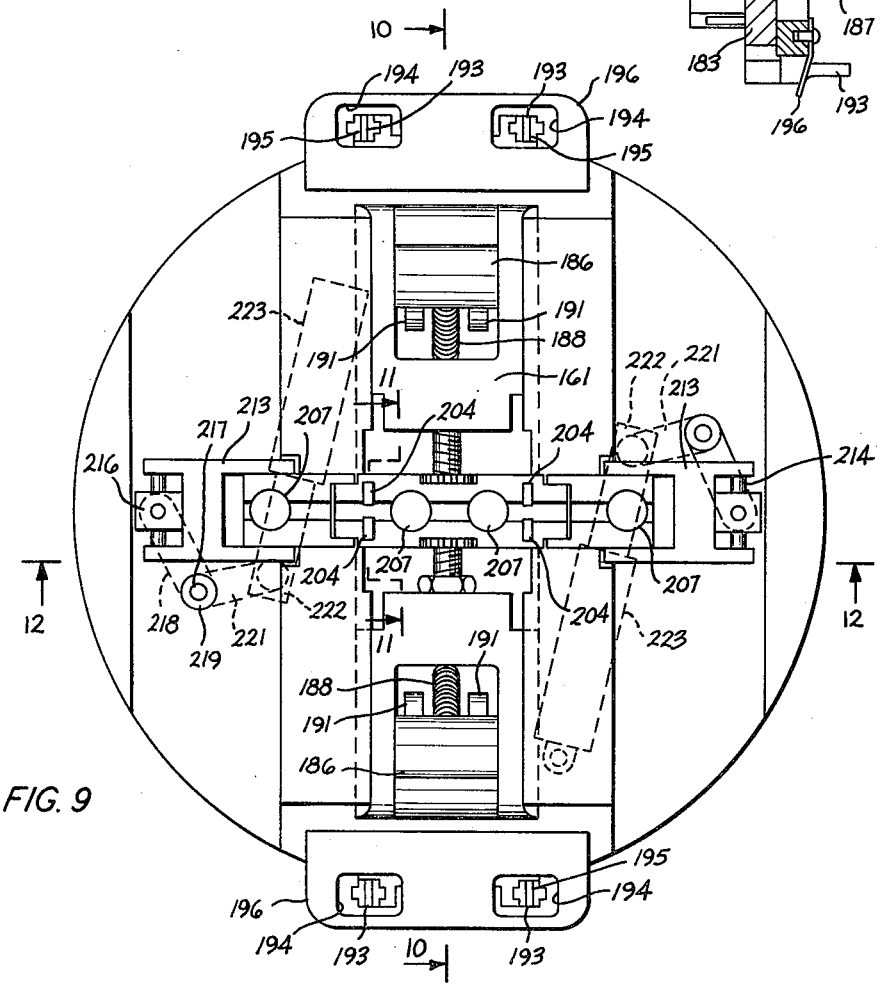
FIG. 9 is a front elevational view of one of two coiling heads and rotated 90° from a normal coiling position shown in FIG. 3.
Figure 11:
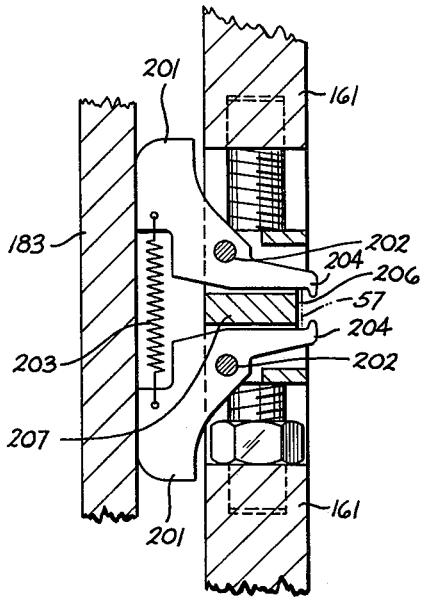
FIG. 11 is a detail view of pawls used to hold a section of deformable tie stock in engagement with the coiling head and taken along lines 11—11 of FIG. 9.

Also as viewed in FIG. 9 and 11, it can be seen that each of the coiling heads 64—64 includes the facilities for holding thereto a section 57 of a strip of deformable tie stock. The holding facilities includes two pairs of pawls 201—201. Each of the pawls 201—201 is pivotally mounted about a pin 202 with a tension spring 203 attached to the lower end thereof. The lower ends of the pawls 201—201 are adjacent the arms 183—183. Each of pawls 201—201 has a hooked end 204 which extends over a length 57 of the deformable tie which is held in engagement with a surface 206 (see FIGS. 9 and 11).

The head 64 also includes a set of four permanent magnets 207—207 (see FIG. 9) spaced therealong in order to attract and hold the deformable tie 57 in engagement with the surface 206. The exposed surfaces of the magnets 207—207 are coplanar with the surface 206. In order to positively hold the tie 57 in engagement with the surface 206, the ends 204—204 of the pawls 201—201 overlie a side portion of the strip 57 of deformable tie as shown in FIG. 11.

When the arms 183—183 are moved to the left as viewed in FIG. 10, the tension spring 203 becomes effective to move the lower end of the pawls 201—201 toward one another. This causes the pawl ends 204—204 to separate and uncover the side portions of the section 57 of deformable tie. Then, when the arms 183—183 are moved back toward the plate 161, the arms engage the lower ends of the pawls 201—201 and overcome the action of the springs 203—203 to close the pawl ends 204—204 over a new section 57 of deformable tie which has been pulled into engagement with the permanent magnets 207—207.

Figure 12:
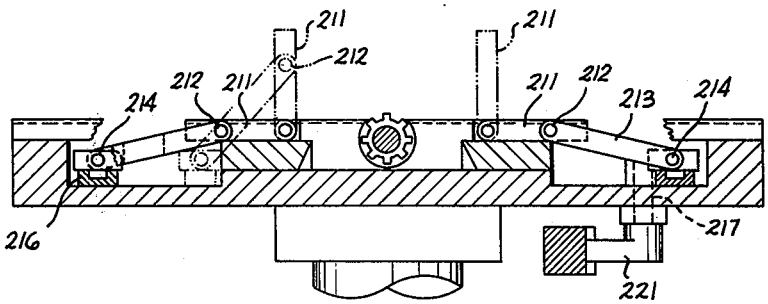
FIG. 12 is an enlarged view of a portion of the coiling head which imparts on initial bend to the section of tie stock and taken along lines 12—12 of FIG. 9.

The head 64 also includes facilities for imparting an initial deformation to the section 57 of tie material held between the pawls 201—201 in engagement with the permanent magnets 207—207. As can best be viewed in FIGS. 9 and 12, these facilities include pivotally mountable uprights 211—211 which may be moved from the plane of the plate 161 upwardly toward the center of the plate to deform or to bend end portions of the tie 57 to an upstanding position normal of the plate 161 (see FIG. 12).

Each of the uprights 211—211 is connected intermediate the ends by a pin 212 to an H-shaped member 213. The H-shaped member 213 is connected at one end thereof to a pin 214 extending through a slide 216. The slide 216 is connected pivotally to a link 218 having a shaft 217 at one end thereof. The shaft 217 passes through a bushing 219 through the plate 164 and connected at its other end to one end of a link 221. The outer end of the link 221 is connected to a clevis 222 attached to the piston rod of an air cylinder 223.

The operation of the air cylinder 223 extends the clevis 222 to rotate the link 218. This causes the slide 216 to move to the right as viewed in FIG. 9 and thereupon cause the H-shaped member 213 to raise the associated upright 211. This imparts a 90° bend to the adjacent end portion 59 of the section 57 of tie.

Binding Facilities

The binding facilities 65 associated with position II include provisions for maintaining the head 64 in a stationary position during the binding of the hank of cordage. The head 64 has a cam 225 (see FIG. 14) attached to an inner side thereof with recessed portions of the cam contour being engaged in position II by selectively operable spring-biased followers 226—226. The engagement of the followers 226—226 with the cam recesses locks the head 64 in an orientation suitable for the binding operation.

The binding facilities 65 are supported from a post 229 and include a pair of binding jaws 231—231 (see FIG. 13) which are mounted about a common shaft 232 which is connected through a support 233 to a piston rod 234 extending from an air cylinder 236. A collar 237 is attached to one end of the air cylinder 236 and has two link bars 238—238. The other ends of the link bars 238—238 are pin connected to te support 233. The operation of the air cylinder 236 retracts the piston rod 234 to cause the link bars 238—238 to urge the jaws 231—231 to move pivotally toward engagement with each other as shown in the phantom position in FIG. 13.

The closing of the jaws 231—231 engages with the upstanding ends of the section 57 of deformable tie to move the tie into a generally oval shaped configuration with the end portions 59—59 of the tie being between the jaws 231—231.

The apparatus 60 in the preferred embodiment is provided with the capability of causing a slight, e.g., 15°, rotation of the head 64 in the binding position prior to the tuck-in of the end portions 59—59 of the tie 57. As can best be seen in FIG. 14, an air cylinder 239 is attached to the frame 73 adjacent position II and has a piston rod 240 adapted upon extension from the air cylinder to engage a wall of a chordal opening 245 in the head 64. The engagement of the rod 240 therewith causes the cam 225 to be rotated with the head 64 overcoming the spring-bias of the followers 226—226. When the piston rod 240 has been fully extended, the engagement of the end with the head 64 and the biased followers 226—226 retain the head 64 in the position slightly rotated from that shown in FIG. 14.

In order to move the jaws 231—231 from an initial closing position to a position within the confines of a coiled cordage 51, an air cylinder 241 is provided. The air cylinder 241 is supported to a plate 242 extending from a frame 243. The air cylinder 241 has a piston 244 connected to a slide 246 dovetailed in a bed block 247. The slide 246 has a plate 248 connected to the support 233. Upon actuation of the air cylinder 241 the piston rod 244 is moved to the right to move the assembly 230 to the right with the ends of the closed jaws 231—231 being moved inwardly of the convolutions of the coiled cordage 51.

Figure 13:
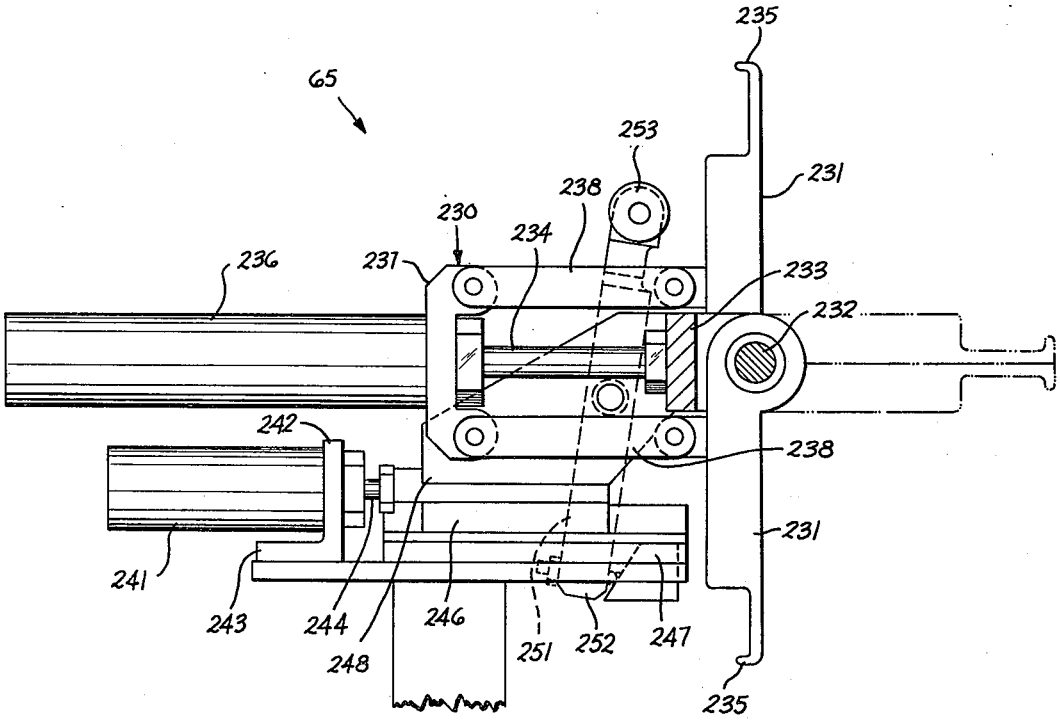
FIG. 13 is an enlarged view of facilities associated with one of the work positions for deforming further the tie into binding engagement with the coiled cordage.

The movement of the assembly 230 to the right as viewed in FIG. 13 also causes a bar 251 which has an end 252 connected to the bed block 247 to be moved pivotally. This causes a stop 253 attached to one end thereof to be moved into a position spaced slightly from the top one of the links 238—238.

The air cylinder 236 is then extended to open the jaws 231—231 However, because of the stop 253, the jaws 231—231 can separate only slightly. This movement is sufficient to cause the upstanding ends 235—235 of the jaws to tuck in the free end portions 59—59 of the section 57 of tie skewed to the linear portion of the spanning generally diametrically the convolutions (see FIG. 1). At that time, the air cylinder 239 is controlled to withdraw the rod 240 to permit the spring-biased followers 226—226 to rotate the cam 225 and head 64 to the position shown in FIG. 14 in preparation for hank ejection and subsequent tie-loading.

Tie Loader

The apparatus 60 is also provided with facilities for applying a section 57 of predetermined length of a deformable tie stock to the coiling head 64 in the binding position, position II. As can best be seen in FIGS. 14, 15 and 16, the tie loading facilities 66 includes a supply 261 mounted rotatably about a post 262. The deformable tie material is drawn through a ceramic eyelet 263 and a guide 265, then between a coacting knurled roller 264 and a feed roller 266 around an arcuately formed guide 267 and again between the knurled roller 264 and a coacting roller 268 made of plastic material. From there the deformable tie stock is fed upwardly through a guide 269 up through openings in juxtaposed plates 271 and 272. From there the deformable tie extends behind a shield 273 made of a plastic material spaced slightly from a member 274 for supporting the tie.

Facilities are provided for severing the deformable tie stock after a predetermined length section 57 thereof has been advanced between the plastic shield 273 and the support member 274. The severing facilities includes a blade 276 mounted in the top plate 272 which is moveable reciprocally to the left as viewed in FIG. 14 to cooperate with a surface 277 to sever the deformable tie stock extending therebetween.

Figure 14:
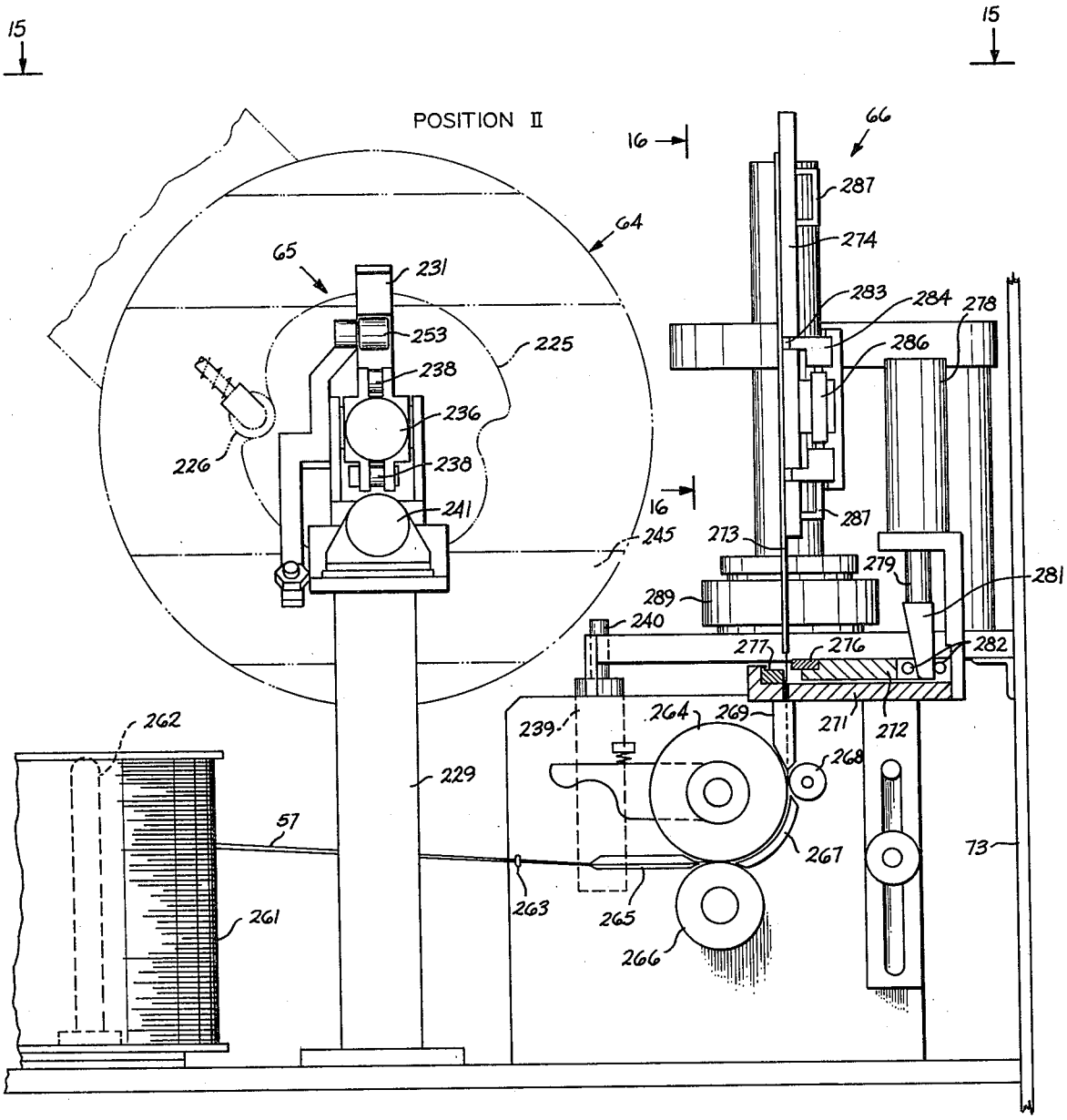
FIG. 14 is an elevational view of a tie loading device for positioning a section of the tie in engagement with one of the coiling heads.

The movement of the blade 276 is caused to occur by operation of an air cylinder 278 which extends an associated piston rod 279 to move a camming member 281 downwardly between two pins 282—282 to cause the plate 272 to be moved to the left as viewed in FIG. 14.

The section 57 of deformable tie stock which is moved between the plastic shield 273 and the support plate 274 spans across two openings 283—283 behind each of which is a pole piece 284 of an electromagnet 286 which is mounted for movement slightly to the left as viewed in FIG. 14. The pole pieces 284—284 function as pushers. The pole pieces or pushers 284—284 are operated to move through associated ones of the openings 283—283 to eject the section 57 of tie stock.

The electromagnet 286 is effective to hold the section of tie material in engagement with the backup plate 274. The electromagnet 286 is rendered effective when the section 57 of tie stock is advanced between the shield 273 and support member 274 and is deenergized simultaneously with the operation of the pushers 284—284 and the moving of the shield 273 to uncover and then permit release of the section 57 of tie.

Figure 15:
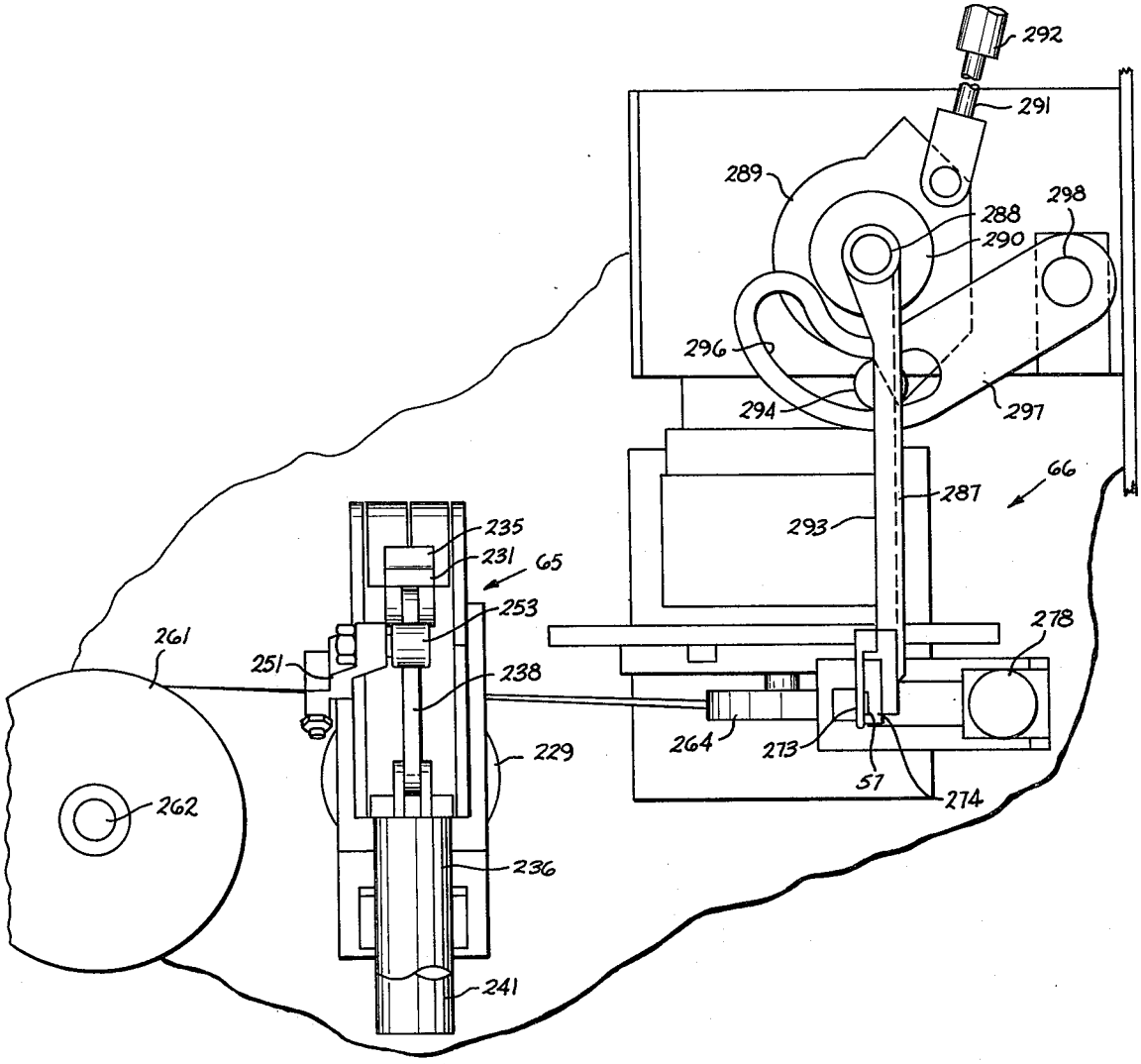
FIG. 15 is a plan view of the tie loading device and taken along lines 15—15 of FIG. 14.
Figure 16:
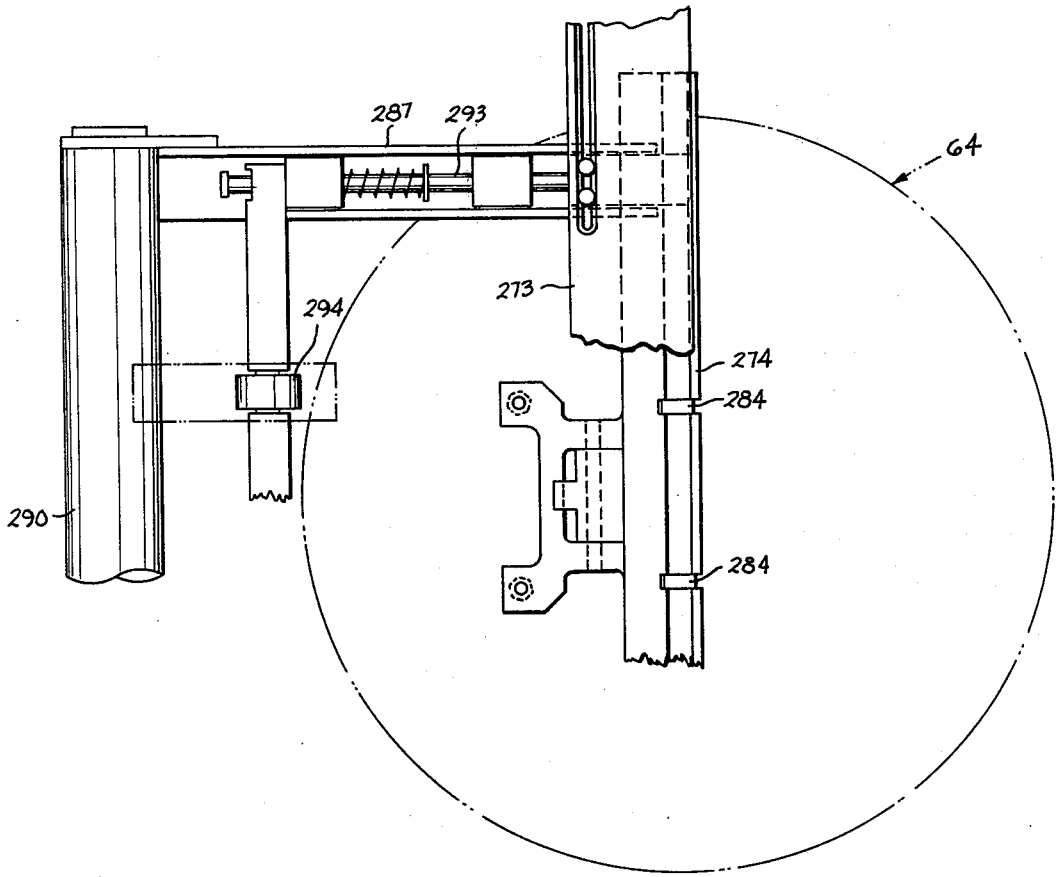
FIG. 16 is a view taken along lines 16—16 of FIG. 14.

The tie loader 66 is also adapted to be moved pivotally so as to move the section 57 of deformable tie stock into engagement with the one of the coiling heads 64—64 which is in position II. In order to accomplish this, facilities are provided as shown in FIG. 15.

These facilities provide that the support member 274 is attached to one end of each of two transfer arms 287—287 which are connected to a hollow shaft 288. The arms 287—287 are mounted so as to be essentially parallel and disposed horizontally of the frame work 73. The hollow shaft 288 is mounted rotatably in bushings on a fixed post 290 and has a hub 289 to which is connected a piston rod 291 extending from an air cylinder 292. The operation of the air cylinder 292 causes a rotation of the shaft 288 to turn rotatably in a clockwise direction as viewed in FIG. 15 thereby moving the transfer arms 287—287 also in clockwise direction and toward engagement with that coiling head 64 in the binding position, i.e., position II.

The arms 287—287 have members 293—293 attached thereto which are moveable together with a follower 294 received in an arcuate slot 296 of an arm 297 mounted pivotally to a column 298. As the arm 287 is rotated, the cam slot 296 causes the follower 294 to move the member 293 to retract the plastic shield 273 to uncover the section 57 of deformable tie. When the tie loader 66 has been moved through approximately 90°, the electromagnet 286 is deenergized and the pole pieces 284—284 operated to urge the tie section into engagement with the permanent magnets 207—207 which attract the tie section to the coiling head. At that time the movement of the arms 183—183 toward the plate 161 also closes the clamping pawls 201—201 over the tie section 57.

The head 64 in position II now preloaded with a section 57 of tie and the head 64 in position I having a hank of cordage with a section of tie deformed into a U shape are now in condition to be revolved about the axis 69 to begin the next cycle of operation.

While the invention has been described in terms of a preferred embodiment with a pair of coiling heads 64—64 which may be interchanged in position, it should be understood that one head could be used to practice the invention. In that event, the one head 64 is preloaded with a section 57 of tie after which a plurality of convolutions are wound thereon. Then the tie section 57 is deformed into a U shape, the head preferably rotated slightly and the tie section further deformed to tuck in the end portions 59—59 thereof. The bound hank of cordage is ejected from the head 64 and another tie section 57 preloaded thereon to begin another cycle of operation.

Operation

An operator (see FIG. 3) inserts a leading end of the cordage 51 through the guide sheaves 71—71 and the coacting guide sheaves 72—72 through the tensioning clamp 74 and into the distributor 62. The operator then grasps the leading end portion of the cordage 51 and inserts the leading end portion into the cordage positioner 63 between the portion 81 of the housing 82 and the clamp member 137 and in engagement with the stop 139 (see FIG. 8A).

Then the operator depresses a pushbutton 399 (see FIG. 17) to initiate the operation of the control system 70 which comprises an electrical control circuit, designated generally by the numeral 400 and a pneumatic control system, designated generally by the numeral 500 (see FIG. 18). Prior to the operation of a main air interlock valve, all elements of pneumatic control system, must be in predetermined positions. If any of the elements are not in initial position, the air interlock valve is not activated.

It should be recognized that the apparatus 60 is a sequential apparatus and that no action is initiated until the preceeding steps has been completed. The sequence of operation may be controlled by the control circuit 400 such as, for example, that shown in FIG. 17. The control circuit 400 includes a timing mechanism designated generally by the numeral 401, which is provided with a motor 402. The motor 402 operates a camming system (not shown) whereby a plurality of contacts of the timing mechanism 401 are cam-controlled thereby energizing a plurality of solenoids to control the apparatus 60.

Assuming that the apparatus 60 has completed at least one cycle of operation, the following operational description is illustrative to the sequential operation of the various controlling air cylinders for the apparatus. Referring to FIGS. 17 and 18, all air cylinders are assumed to be in a rest-unoperated position. The depression of the pushbutton 399 causes the cylinder 133 to be operated to clamp the cordage 51. At this time it is assumed that the cordage positioner 63 is in the left most position as shown in FIG. 6 (also see FIG. 4A).

Thereafter the rotational movement of the motor 402 results in a cam-closing of a contact 403 (see FIG. 17) of the timing mechanism 401 whereby an associated solenoid 404 is energized. As the solenoid 404 is energized, an air valve 503 (see FIG. 18) is opened to supply pneumatic pressure to air cylinder 114 to move the cordage positioner 63 out of the plane of the paper as shown in FIG. 6 or counterclockwise as shown in FIG. 7 to the "travel position".

Shortly thereafter, a switch 406 is cam-closed to cause the operation of the stepper motor 92 shown in FIGS. 3 and 6. The operation of the stepper motor 92 causes the cordage positioner 63 to be moved to the right as shown in FIG. 6 until the plate 93 (see FIG. 7) engages the right-most collar 97. Continued operation of the stepper motor 92 causes the plate 93 to carry the collar 97 and the rod 96 to the right as viewed in FIG. 6 until the stop 98 is disengaged from the limit switch 99. This causes a discontinuation of the motor 92 for a preset delay time with the leading end of cordage 51 in a position just to the right of the top right hand clamp 193 as shown in FIG. 4B.

At that time the switch 403 is cammed open to deenergize the solenoid 404 to control the valve 504 so as to cause the air cylinder 504 to move the cordage positioner 63 in toward the paper as shown in FIG. 4B. In other works, the cordage positioner 63 is moved clockwise as viewed in FIG. 7 toward the "cord inserting" position. The arcuate slot 94 in the plate 93 permits the pivotal movement without interference by the rod 96. Simultaneously a switch 408 is cammed closed to energize a solenoid 409. The solenoid 409 controls a valve 509 to operate the air cylinder 68 to tension the cordage 51 sufficiently to facilitate the insertion of the leading end thereof in the one of the clamps 193—193.

The air cylinder 114 continues to pivot clockwise, as viewed in FIG. 7, the cordage positioner 63. This causes the leading end of the cordage 51 to be placed between the resilient fingers 195—195 of the top right-hand clamp 193 of the head 64 now in position I whereupon the cylinder is operated to cause the clamp 137 to release the leading end of the cordage 51. Continued rotation of the shaft of the motor 402 causes the switch 403 to be cam-closed to energize the solenoid 404 to cause the air valve 504 to move the cordage positioner 63 out of the paper (counterclockwise as viewed in FIG. 7 to the travel position) away from the clamp 193 on the head 64.

At that time, and after the preset delay, the motor 92 is caused to be operated in a reverse direction to move the cordage positioner 63 a predetermined distance to the left as shown in FIG. 6 while being spaced from the head 64 in the winding position I.

Then, the timing mechanism 401 causes a contact 411 to be closed to cause driving facilities (not shown) to engage the clutch 172 of the head 64 in the coiling position to cause that head to be turned rotatably to wind cordage material 51 around the posts 186—186 with a length of tie 57 spanning diametrically and underlying the convolutions. The convolutions of the coil are somewhat elongated with one end of the cordage 51 held maintained in the one clamp 193. At the conclusion of the coiling operation, the orientation of the winding head 64 with respect to the free end of cordage 51 is as shown in FIG. 4C.

As the cordage positioner 63 is moved to the left as viewed in FIG. 6, the plate 93 (see FIG. 7) engages the left-most collar 97 and carries the collar 97 and attached rod 96 to the left a slight distance of about one inch. This movement of the rod 96 causes the stop 98 to reengage the limit switch 99 to discontinue the travel of the cordage positioner 63 along the shaft 88 a preset time to permit serving of the cordage 51 and attachment of the trailing end to one of the clamps 193—193 on the head 64 in position I.

The operation of the motor 402 re-opens the switch 403 to deenergize the solenoid 404. This controls the air valve 504 which operates the air cylinder 114 to move pivotally the cordage positioner 63 clockwise as viewed in FIG. 7 to move the cordage 51 toward engagement with another adjacent associated one of the clamps 193 such that the cordage is in the position shown in FIG. 4C.

The timing mechanism 401 causes a switch 416 to be cammed closed to energize an associated solenoid 417. This controls an air valve 517 to operate the air cylinder 80 (see FIG. 5) which causes the distributor to be moved outwardly toward the inwardly moving cordage positioner 63. These motions complement each other to cause a portion of the cordage 51 to be seated positively in the cordage positioner 63.

At that time, the rotation of the motor 402 causes the closing of a switch 421 which energizes a solenoid 422. This closes an air valve 522 which operates the air cylinder 131 to cause the blade 121 (see FIG. 8) to sever the cordage 51 and to clamp the newly formed leading end thereof to the portion 81 of the housing 82.

Substantially simultaneously, the timing mechanism 401 causes a cam-closing of a switch 426 which energizes a solenoid 427. The solenoid 427 controls an air valve 527 to operate the air cylinder 133 (see FIG. 8) to move the clamp 137 (see FIG. 8A) into securing engagement with the just-formed trailing end portion of the cordage 51. The stop 139 prevents movement of the cordage during severing.

The air cylinder 114 continues to move the cordage positioner clockwise as viewed in FIG. 7 to move the trailing end portion of the cordage between resilient fingers 195—195 of the clamp 193 to seat the cordage. Simultaneously, the timing mechanism 401 causes the air valve 517 to be controlled to operate the air cylinder 80 to withdraw the rollers 75 and 76 to the left as viewed in FIG. 5.

Then, the timing mechanism 401 causes the switch 426 to be opened to deenergize the associated air valve 427. The air valve 527 is controlled to operate the air cylinder 133 to disengage the clamp 137 from the trailing end of the cordage 51. Simultaneously, the timing mechanism 401 causes the air cylinder 114 to be operated to move the cordage positioner 63 counterclockwise as viewed in FIG. 7 to the extreme right position in preparation for travel thereof along the shaft 88 following the preset delayed operation of the motor 92.

While the trailing end of the cordage 51 is being secured in one of the clamps 193—193 (see FIG. 4C), the timing mechanism 401 closes a switch 428 which energizes solenoids 429—429. This controls associated air valves 529—529 to operate the air cylinders 223—223 to move the uprights 211—211 to the phantom-line positions shown in FIG. 12 to impart an initial 90° bend to end portions of the tie 57 (see FIG. 2B).

Simultaneously with the winding of the cordage 51 in position I, continued operation of the motor 402 causes a switch 431 to be cam-closed which energizes an associated solenoid 432 to move the cordage-binding device 65 (see FIG. 13) to bind the priorly coiled cordage which is now in position II. As can best be seen in FIG. 18, the energization of the solenoid 432 operates an associated air valve 532 to cause the operation of the air cylinder 236 which moves the jaws 231—231 toward each other into essentially the phantom position shown in FIG. 13. It should be observed that the jaws 231—231 are generally completely closed upon one another and the free end portions of the tie 57 are moved toward engagement with one another and into recesses (not shown) formed in the jaws 231—231.

As the jaws 231—231 of the head 64 in the binding position II are being closed, the timing mechanism 401, causes a switch 433 to be opened to energize the solenoids 434—434. This controls associated air valves 534—534 to operate the air cylinders 223—223 of the head in position II to move pivotally the uprights 211—211 to the solid line position shown in FIG. 12 within the plane of the head 64. In a preferred embodiment, this retraction of the uprights 211—211 is delayed until the bound hank 50 is ejected from the apparatus 60. This delayed retraction advantageously assists in retaining the cordage 51 on the head 64 during the binding operation and becomes especially helpful should the apparatus 60 have failed to place the trailing end of the cordage in the clamp 193 while in the winding position.

At this time in the preferred embodiment, the coiling head 64 in position II is caused to rotate slightly. The timing mechanism 401 closes a switch 436 to energize a solenoid 437. This causes an associated air valve 537 to be controlled to operate the air cylinder 239 which extends its associated piston rod 240 into engagement with a wall of the channel-shaped opening 245 in the head 64 in the binding position to urge the head to rotate counterclockwise as viewed in FIG. 14. This causes the cam 225 to be rotated slightly with the spring-biased followers 226—226 being overcome and riding along the faces of the cam. The followers 226—226 hold the cam 225 in the slightly, e.g., 15°, rotated position while the binding is completed. This causes the free end portions of the deformable tie 57 to be offset from the straight run of the tie material held against the permanent magnets 207—207.

The continued rotation of the motor 402 causes the closing of a switch 441 which energizes solenoid 442 to operate an associated air valve 542 which operates the air cylinder 241 to move the binding jaws 231—231 to the right as shown in FIG. 13. This causes the free end portions 59—59 of the tie material 57 to be moved inwardly between the elongated convolutions of the cordage 51. Also, the stop 253 is moved to the right as viewed in FIG 13 to be generally adjacent and spaced slightly from one of the link bars 238—238.

Then, the rotation of the motor 402 causes the opening of the switch 431 to deenergize the solenoid 432 which controls the air valve 532 to extend slightly the piston rod 234 of the cylinder 236 thereupon tending to open the binding jaws 231—231. However, because of the position of the stop 253 relative to the one link bar 238, the jaws can only be moved apart slightly. This causes the free ends of the deformable tie material 57 to be tucked under the associated ones of the long runs of the convolutions of the coiled cordage. Also, as can best be seen in FIG. 1, the tucked-in portions are skewed to the portion of the tie spanning generally diametrically the convolutions.

The timing mechanism 401 causes a reclosing of the switch 431 to reenergize the solenoid 432 and operate the air valve 517. The jaws 231—231 are reclosed upon one another. Then the switch 441 is opened to deenergize the solenoid 442 and cause the air cylinder 241 to be operated to withdraw the jaws 231—231 to the left as shown in FIG. 13 out from the vicinity of the coiled cordage.

The motor 402 then causes the solenoid 437 to be deenergized which controls the valve 537 to operate the air cylinder 239 to withdraw the piston rod 240 to permit the spring-biased followers 226—226 to return the coiling head 64 in the binding position through the 15° angle to the position shown in FIG. 14.

At the conclusion of the winding of cordage on the coiling head 64 in position I, the apparatus 60 is caused to be operated to eject the previously wound cordage, now secured, on the coiling head in position II. The operation of the motor 402 causes a switch 446 to be closed which energizes an associated solenoid 447. This controls an associated air valve 547 to cause the air cylinder 176 (see FIG. 10) to be operated to move the claw-like member 174 to withdraw the rod 178 to the left as viewed in FIG. 10. This causes the arms 183—183 to be spaced from the plate 164 thereby permitting the springs 188—188 to become effective to move pivotally the winding posts 186—186 within the openings 162—162. Also, the clamps 193—193 are drawn through the stripper plates 196—196 to cause the coiled cordage 51, now secured, to be ejected.

It will be recalled that at this time in the preferred embodiment, the uprights 211—211 are retracted from their upright position. This is accomplished by the control of the valves 434—434 to operate the air cylinders of the head 64 in position II.

Simultaneously with the winding of the cordage 51 in position I and the binding of a hank in position II, the tie loader 66 (see FIG. 14) is operated to move another section 57 of the deformable tie material into alignment with the head 64 in the coil-binding position II. The turning of the motor 402 causes the cam shaft to close a switch 451 to thereupon cause the operation of the rotation of the feed roller 266 which causes the deformable tie material to be advanced between it and the sheave 264 around arcuate guide 267 up through the guide 269 and between the shield 273 and the stationary plate 274.

Then, the motor 402 causes the switch 451 to be opened to discontinue the advance of the deformable tie material whereafter a switch 456 is closed to energize a solenoid 457 to operate an associated air valve 557. The operation of the valve 557 operates the air cylinder 278 to move the camming member 281 downwardly. This causes the blade 276 to be moved reciprocally to the left as viewed in FIG. 14 to shear the deformable tie material along the surface 277.

After the deformable tie material has been fed between tie shield 273 and the backup plate 274 and severed from the supply and after the bound hank 50 has been ejected from the apparatus 60, the tie loader 66 is controlled to be moved through a 90° angle (see FIGS. 15 and 16) in order to engage the section 57 of tie material with the head 64 in position II. At that time, continued operation of the motor 402 closes contact 461 which energizes a solenoid 462. This operates an associated air valve 562 which operates the air cylinder 292 to move pivotally the tie loader 66. As can best be seen in FIG. 15, the shield 273 is moved to uncover the tie section 57 which is held by the electromagnet 286 in engagement with the backup plate 274. As the loader 66 is swung through the 90° angle, the tie 57 is brought into engagement with the permanent magnets 207—207 on the head 64. The electromagnet 286 is deenergized and the pole pieces 284—284 are caused to impart a slight movement to the section 57 of the tie to seat the tie in engagement with the magnets 207—207.

At this time also, the continued operation of the motor 402 opens the switch 446 to deenergize the solenoid 447 to control the associated air valve 547 which moves the cylinder 176 (see FIG. 10). The operation of the air cylinder 176 causes the rod 178 to be moved to the right as shown in FIG. 10. This causes the clamps 193—193 to be brought through the stripper plates 196—196 with the camming members 191—191 being engaged by the surfaces 192—192 of the arms 183—183 to move the winding posts 186—186 to an upright position. Moreover, the movement of the arms 183—183 towards the plate 164 causes the clamping pawls 201—201 to be moved pivotally overcoming the action of the tension spring 203 to move the pawl portions 204—204 over the tie section 57 thereupon holding securely the tie section in engagement with the surface 206 (see FIG. 11).

The movement of the winding posts 186—186 on the head 64 in position II to the upright position is accompanied by the operation of the air cylinder 292 to return the tie loader 66 through the 90° angle. The switch 461 is opened to deenergize the solenoid 462 and control the associated air valve 562 to operate the air cylinder 292 to return the tie loader 66 to the position shown in FIG. 15 with the section of the deformable tie material now on the head 64 in the hank binding position. At this time, the deformable tie material section 57 is held in place by the permanent magnets 207—207 and the pawl portions 204—204 on the head in the binding position.

Subsequently, the continued operation of the motor 402 closes a switch 466 to cause facilities (not shown) to rotate clockwise as viewed in FIG. 3 the turret 150 on which is supported the rotatable heads 64—64. Each of the heads 64—64 is revolved in a clockwise direction as viewed in FIG. 3 to move the head with the coiled cordage from the coiling position I to the binding position II and to move the head having the section of deformable tie loaded thereupon into the coiling position I.

The apparatus 60 is now in condition for another cycle of operation during which the head 64 now in position I and preloaded with the tie 57 has a new leading end of the cordage 51 attached to one of the clamps 193—193 thereof (see FIG. 4B) and a plurality of convolutions of cordage 51 wound thereon.

It is to be understood that the above-described arrangements are simply illustrative of the invention. Other arrangements may be devised by those skilled in the art which will embody the principles of the invention and fall within the spirit and scope thereof.

What is claimed is:

1. A method of forming bound coils of cordage, which includes the steps of:

supporting a tie in one work position;

winding a plurality of convolutions of cordage in the one work position to form a coil such that the tie spans generally diametrically the convolutions with end portions of the tie extending beyond opposed portions of the convolutions and such that leading and trailing ends of the cordage are oriented in the same direction; while reforming a tie in another work position spanning generally diametrically the convolutions of a previously wound coil of cordage to move each end portion of the tie into enclosing securing relationship with associated corresponding portions of the plurality of convolutions to bind together the corresponding portions;

removing the bound coil of cordage from the other work position;

positioning another tie in the other work position; and moving the coil of cordage from the one work position to the other work position while moving the tie from the other work position into the one work position to facilitate another cycle of winding cordage in the one work position and binding the already wound coil of cordage in the other work position.

2. A method of forming bound coils of cordage, which includes the steps of:

supporting a tie in one work position; while winding a length of cordage into a plurality of convolutions in the one work position to form a coil such that the tie spans generally diametrically the convolutions with end portions of the tie extending beyond opposed portions of the convolutions and such that leading and trailing ends of the convolutions are oriented in the same direction;

positioning a next successive tie into another work position;

moving the coiled cordage from the one work position to the other work position while moving the next successive tie from the other work position to the one work position;

winding a next successive plurality of convolutions of cordage in the one work position while reforming the tie in the other work position to move end portions of the tie into enclosing securing relationship with associated corresponding portions of the plurality of convolutions to bind together corresponding portions of the plurality of convolutions;

removing the bound coiled cordage from the other work position; and positioning a next successive tie into the other work position preparatory to the moving of the tie into the one work position and the coiled cordage into the other work position to facilitate another cycle of winding cordage in the one work position and binding the priorly coiled cordage moved into the other work position.

3. The method of claim 2, wherein prior to the movement of the coiled cordage from the one work position into the other work position, the end portions of the tie are deflected pivotally to form a generally U-shaped configuration with each of the upstanding end portions of the tie adjacent the external faces of the adjacent associated corresponding portions of the plurality of convolutions.

4. The method of claim 3, wherein prior to the completion of the moving of the end portions of the tie into enclosing securing relationship with the associated corresponding portions of the coiled cordage in the other work position, the coiled cordage is rotated slightly about an axis through the center of the convolutions and normal generally to the planes thereof, and the reforming includes deflecting inwardly of the convolutions the upstanding end portions in a plane skewed to the axis of the portion of the tie interconnecting the end portions to facilitate enclosing the corresponding portions of the convolutions with the associated one of the end portions of the tie.

5. The method of claim 2, wherein prior to the winding of the convolutions of cordage in the one work position, a leading end of the cordage is secured to a coiling head and wherein, subsequent to the winding of the convolutions, the cordage is severed along that portion interconnecting the last convolution and a supply to form a trailing end extending from the final convolution and a leading end extending from the supply, and further, the trailing end then being secured to the coiling head, and the leading end being held for attachment to the coiling head presently in the other work position when said head is moved into the one work position in the next successive cycle of operation.

6. A method of forming a coil of a plurality of convolutions of cordage in which corresponding portions of the plurality of convolutions are bound together with a deformable tie at diametrically opposite portions of the coil, which includes the steps of:

loading a deformable tie having an essentially linear configuration onto a first rotatably device while in a tie-loading and binding position;

moving the first rotatable device into a winding position and a second rotatable device into the tie-loading and binding position;

attaching a leading end of cordage from a supply to the rotatable device in the winding position;

winding a plurality of convolutions of cordage from the supply onto the first rotatable device in the winding position such that the preloaded tie spans generally diametrically of the convolutions and that free end portions of the tie extend beyond each of diametrically opposite portions of the coiled cordage;

severing the coiled cordage from the supply to form a trailing end extending from the coiled cordage with the leading and trailing ends of the coiled cordage extending in the same direction; while moving end portions of the tie pivotally to form the tie into a generally U-shaped configuration with each of the end portions thereof upstanding and adjacent the external faces of an associated plurality of corresponding portions of the convolutions;

moving the second rotatable device into the winding position and the first rotatable device into the binding position;

windng a plurality of convolutions of cordage onto the second rotatable device now in the winding position; while deforming the upstanding end portions of the tie on the first rotatable device to move the end portions inward toward the center of the coil and then toward an underside of the associated plurality of convolutions thereupon providing a coiled cordage having a plurality of convolutions with associated corresponding portions of the convolutions being bound together at least at diametrically opposite portions of the coil;

rotating the second rotatable device through a predetermined angle in the binding position prior to the movement of the end portions of the tie toward the underside of the convolutions to skew the end portions to the linear portion and then causing the first rotatable device to be returned through the predetermined angle; and ejecting the bound coiled cordage from the first rotatable device while preparing to load the first rotatable device with another deformable tie in preparation for another cycle of operation.

7. An apparatus for forming bound coiled strand material, which includes:

means for supporting a tie in a work position;

means for coiling a plurality of convolutions of strand material in the work position such that the tie spans generally diametrically the convolutions with end portions of the tie extending beyond the convolutions and such that both the leading and trailing ends of the coiled convolutions are accessible and oriented in the same direction;

means for reforming the tie to move each of the end portions thereof into enclosing securing relationship with adjacent associated corresponding portions of the plurality of convolutions to bind together each plurality of corresponding portions;

means for removing the bound coiled strand material; and means for positioning another tie in preparation for another cycle of coiling and binding strand material.

8. An apparatus for forming bound coiled cordage, which includes:

means for supporting a tie in one work position;

means for winding a length of cordage into a plurality of convolutions in the one work position to form a coil such that the tie spans generally diametrically the convolutions with end portions of the tie extending beyond the convolutions and such that leading and trailing end portions of the wound length of cordage extend from the coil and in the same direction;

means for reforming a tie in another work position spanning generally diametrically the convolutions of a previously coiled cordage to move each end portion of the tie into enclosing securing relationship with associated corresponding portions of the plurality of convolutions to bind together the corresponding portions;

means for removing the bound coiled cordage from the other work position;

means for positioning another tie in the other work position; and means for moving the coil of cordage from the one work position to the other work position while moving the tie from the other work position into the one work position to facilitate another cycle of winding cordage in the one work position and binding the already wound cordage in the other work position.

9. An apparatus for forming bound coiled cordage, which includes:

means for supporting a tie in one work position;

means for winding a plurality of convolutions of cordage in the one work position to form a coil such that the tie spans generally diametrically the convolutions with end portions of the tie being accessible and extending beyond the convolutions in the same direction;

means for positioning a next successive tie into another work position;

means for moving the coiled cordage from the one work position to the other work position while moving the next successive tie from the other work position to the one work position;

means for winding a next successive plurality of convolutions of cordage in the one work position while reforming the tie in the other work position to move end portions of the tie into enclosing relationship with associated corresponding portions of the plurality of convolutions to bind together corresponding portions of the plurality of convolutions;

means for removing the bound coiled cordage from the other work position; and means for positioning a next successive tie into the other work position preparatory to the moving of the tie into the one work position and the coil into the other work position to facilitate another cycle of winding cordage in the one work position and binding the priorly coiled cordage moved into the other work position.

10. An apparatus for coiling and binding cordage with a length of deformable tie, which includes:

spaced coiling heads individually cyclically operable for having a length of cordage coiled thereon;

means mounting the heads individually for rotation and together for revolution cyclically between a coiling position and a binding position;

means effective for loading the head in the binding position with a length of deformable tie having a linear configuration;

means rendered effective when a coiling head preloaded with a length of tie is in the coiling position for attaching a leading end of a supply of cordage to the head;

means for causing rotation of the head in the coiling position to wind a predetermined number of convolutions on the head such that the length of tie underlies and spans generally diametrically the convolutions with end portions of the tie extending beyond the convolutions;

means rendered effective subsequent to the winding of a predetermined number of convolutions of cordage on the head for severing the wound cordage from the supply and attaching the trailing end of the wound cordage to the head;

means rendered effective at a conclusion of the winding of cordage on the head in the coiling position for moving end portions of the tie which extend beyond the convolutions pivotally to form a generally U-shaped configuration with each now upstanding end portion being adjacent the external faces of an associated plurality of corresponding portions of the convolutions;

means for rotating the mounting means to revolve the head on which the cordage is wound into the binding position and the head preloaded with a tie into the coiling position; and means rendered effective subsequent to the movement of a wound cordage into the binding position for moving the upstanding end portions of the tie inwardly and then about the associated corresponding portions of convolutions to bind each plurality of the associated corresponding portions with the associated end portion of the tie.

11. The apparatus of claim 10, wherein each of the heads includes means for holding the length of tie to the head and wherein the loading means includes:

means for advancing a strip of tie from a supply;

means for severing a length of the tie;

means including magnetic means for supporting the length of tie in alignment with the head in the binding position;

means for transferring the length of tie into proximate engagement with the holding means; and means rendered effective upon transfer of the length of tie into proximate engagement with the head for urging the length into engagement with the holding means and for rendering ineffective the magnetic means on the supporting means to release the tie.

12. The apparatus of claim 10, wherein each of the coiling heads includes spaced pairs of clamps such that the attaching means inserts a leading end of the cordage into one of the clamps and a trailing end of the cordage into another one of the clamps and the winding is such that the trailing end of cordage is oriented toward the same end of the coiled cordage as is the leading end.

13. The apparatus of claim 12, which also includes:

means mounting the attaching means for movement parallel to the plane of the coiling head;

means mounting the attaching means for pivotal movement inwardly toward the head in the coiling position;

means within the attaching means for clamping and severing cordage strung therethrough and effective upon attaching the newly formed trailing end to the head for releasing the trailing end and being moved pivotally of the head; and means included in the attaching means and rendered effective upon severing of the cordage for holding the newly formed leading end of cordage to facilitate attachment thereof to the head which is in the coiling position at the beginning of the next cycle of operation.

14. An apparatus for coiling and binding cordage, which includes:

an indexable turret which includes a pair of spaced rotatable coiling heads, each of which is indexed between a coiling position whereat convolutions of cordage are wound on the coiling head and a binding position whereat corresponding portions of the convolutions are bound together and the coiled, bound cordage ejected from the apparatus;

means rendered effective subsequent to the ejecting of cordage from the coiling head in the binding position for loading a linear section of a deformable tie on the coiling head;

means on each of the coiling heads for holding the tie on the head and for releasing the tie as the cordage is ejected from the apparatus;

means rendered effective by one of the heads loaded with a tie being indexed into the coiling position for attaching a leading end of a supply of cordage to the head and responsive to discontinuation of winding of convolutions of cordage thereon for severing the cordage from the supply and for attaching the trailing end of the convolutions to the coiling head while retaining the new leading end;

means rendered effective by the attaching of the cordage to the head in the coiling position for winding convolutions on the head;

means rendered effective during the attachment of the trailing end portion of the wound cordage to the head in the coiling position for moving each of the end portions of the tie to form a generally U-shaped configuration with each upstanding end portion being adjacent external faces of associated corresponding portions of the plurality of convolutions;

means rendered effective subsequent to the initial deformation of the tie for moving rotatably the turret to revolve the coil into the binding position and the preloaded head into the coiling position;

means rendered effective subsequent to one of the heads being indexed into the binding position and having cordage wound thereon for deforming portions of the tie about corresponding portions of the convolutions to secure together the corresponding portions of the convolutions; and means rendered effective upon the securing together of the convolutions for ejecting the coiled-bound cordage from the head.

15. An apparatus for forming bound hanks of cordage, which includes:

an indexable turret;

a pair of spaced coiling heads mounted rotatably on the turret for cyclical movement between a winding position and a binding position, each of the coiling heads including;

means mounted pivotally and normally extending laterally of the coiling head for holding a plurality of convolutions;

spaced means mounted on the coiling head for holding end portions of the cordage;

means for holding a section of a deformable tie substantially coplanar with the head;

means operated subsequent to the coiling of a predetermined number of convolutions on the coiling head for deflecting pivotally end portions of the tie from the plane of the head to form a generally U-shaped configuration with each end portion adjacent the external surfaces of adjacent corresponding portions of the plurality of convolutions; and means for moving pivotally the means for holding the convolutions and for removing the end portions of the cordage from the holding means to release the cordage and for releasing the tie to permit ejecting of the bound cordage;

means for attaching a leading end of the cordage to one of the end holding means of the head in the winding position;

means effective upon conclusion of a cycle of winding for severing the cordage from a supply thereof and for attaching the trailing end to an adjacent one of the holding means of the coiling head;

means rendered effective by the coiled cordage being moved to the binding position for deflecting further each of the end portions of the tie into securing engagement with the associated corresponding portions of the convolutions to bind associated portions of the convolutions;

means for causing cordage to be wound on the head in the winding position while a priorly wound cordage is bound in the binding position;

means operated subsequent to the binding of the convolutions of the cordage on the head in the binding position for operating the ejecting means to remove the bound cordage from the head;

means operated subsequent to ejecting the bound cordage for loading another tie section on the head in the binding position; and means for rotating the turret to revolve the heads to interchange the positions of the heads to begin another cycle of operation.

16. An apparatus for coiling and binding cordage, which includes:

first and second workholders mounted individually rotatably and jointly cyclically revolvable between a winding position and a binding position;

means for feeding and severing a length of deformable tie from a supply;

means pivotally mounted on each of the workholders for holding a plurality of convolutions of cordage and for holding a length of deformable tie material in a substantially linear configuration;

means for revolving the workholders to position the workholder preloaded with the length of tie in the winding position and a length of wound cordage into the binding position;

means for attaching a leading end of the cordage to the workholder in the winding position;

means for moving rotatably the workholder in the winding position to wind a plurality of convolutions of cordage on the workholder such that the length of tie spans diametrically the convolutions between the convolutions and the workholder with end portions of the tie extending beyond the convolutions;

means rendered effective at the conclusion of each cycle of winding for severing the cordage from the supply and for attaching the newly formed trailing end of cordage to the workholder in the winding position;

means operated subsequent to the winding of the convolutions on the workholder in the winding position for moving pivotally the end portions of the length of tie in the winding position to form the tie into a generally U-shaped configuration with each of the free end portions upstanding and adjacent associated corresponding portions of the plurality of convolutions;

means for revolving the workholders to move the workholder having the convolutions thereon into the binding position and the workholder preloaded with the tie into the winding position;

means responsive to a wound cordage transferred to the binding position for deflecting further the upstanding end portions of the tie to secure the end portions about the adjacent plurality of corresponding portions of the convolutions to bind the corresponding portions;

means operated subsequent to the binding of the cordage on the workholder in the binding position for releasing the tie and for ejecting the bound cordage from said workholder in preparation for receiving a next successive length of tie to begin another cycle of operation; and means rendered effective subsequent to the ejecting of the bound cordage from the workholder in the binding position for transferring a severed section of tie to said workholder.

* * * * *